US006227444B1

(12) United States Patent
Makoesky et al.

(10) Patent No.: US 6,227,444 B1
(45) Date of Patent: May 8, 2001

(54) EXPANDABLE ENVELOPE CONSTRUCTION

(75) Inventors: Marvin A. Makoesky, Sand Point; Jerome B. Schwartz, Mineola, both of NY (US)

(73) Assignee: Pama Enterprises, Inc., New York, NY (US)

( * ) Notice: Subject to any disclaimer, the term of this patent is extended or adjusted under 35 U.S.C. 154(b) by 0 days.

(21) Appl. No.: 09/506,126

(22) Filed: Feb. 17, 2000

(51) Int. Cl.[7] ..... B65D 27/14; B65D 27/34

(52) U.S. Cl. ..... 229/313; D19/3; 206/424; 229/68.1; 229/75; 229/103.2; 229/928

(58) Field of Search ..... 229/313, 76, 68.1, 229/928, 117.06, 75, 67.3, 103.2; D19/3; 383/122; 206/424

(56) References Cited

U.S. PATENT DOCUMENTS

| | | | | |
|---|---|---|---|---|
| D. 250,590 | * | 12/1978 | Cohn et al. | D19/3 |
| D. 295,536 | * | 5/1988 | Forbes, Jr. | D19/3 |
| 768,340 | * | 8/1904 | Ormsbee, Jr. | 383/122 |
| 960,384 | * | 6/1910 | Norman | 229/75 |
| 1,749,005 | * | 3/1930 | Taylor | 383/122 |
| 2,310,371 | * | 2/1943 | Lines et al. | 229/313 |
| 2,631,772 | * | 3/1953 | Hiersteiner | 229/67.3 |
| 3,073,508 | * | 1/1963 | Hiersteiner | 229/68.1 |
| 3,125,279 | * | 3/1964 | Watts et al. | 229/68.1 |
| 3,144,979 | * | 8/1964 | Young | 229/68.1 |
| 3,198,420 | * | 8/1965 | Hiersteiner | 229/68.1 |
| 3,552,640 | * | 1/1971 | Young | 229/68.1 |
| 3,648,923 | * | 3/1972 | Young | 229/68.1 |
| 3,860,164 | * | 1/1975 | Dworkin | 383/122 |
| 3,944,131 | * | 3/1976 | Weiss | 229/103.2 |
| 3,955,749 | * | 5/1976 | Turkenkopf | 383/122 |
| 4,008,650 | * | 2/1977 | Alter et al. | 229/68.1 |
| 5,398,866 | * | 3/1995 | Bluemle | 229/68.1 |
| 5,503,328 | * | 4/1996 | Roccaforte et al. | 229/313 |
| 5,799,862 | * | 9/1998 | Gray | 229/68.1 |
| 6,109,511 | * | 8/2000 | Schluger | 229/103.2 |

* cited by examiner

*Primary Examiner*—Stephen P. Garbe
(74) *Attorney, Agent, or Firm*—Francis C. Hand; Carella, Byrne, Bain, Gilfillan, Cecchi, & Olstein

(57) ABSTRACT

A single blank is used to make an expandable envelope construction having four side edges which can expand as the envelope construction is filled to capacity. The blank is provided with horizontal and vertical score lines and fold lines which permit the sides and bottom of the construction to collapse inwardly while the pocket enlarges in thickness and decreases in height and width. The blank has side flaps with rounded comers at the ends which are overlaid by the back panel and closure panel in an unsecured manner to maintain the envelope in a sealed condition when expanded.

14 Claims, 6 Drawing Sheets

EXPANDABLE ENVELOPE CONSTRUCTION

This invention relates to an expandable envelope construction.

As is known, envelopes have been constructed for a number of purposes, for example, for the mailing of letters, business correspondence, merchandise, such as CD carriers and the like through the mails and thus need to conform to specified size requirements. Envelopes have also been constructed for use in the filing of various types of materials and in some cases, have been constructed to expand in order to increase the capacity of the envelope. Generally, these envelopes have been glued and finished by hand. In addition, these envelopes have had an internal gusset construction which restricts the insertion of papers.

Typically, the degree to which an expandable envelope can be expanded has been limited. Further, should an envelope become overstuffed, the edges tend to become rounded with the appearance of the envelope becoming less than aesthetically pleasing.

U.S. Design Pat. No. 405,823 illustrates an envelope for commercial literature which has tapered edges on three sides and an enlarged pocket. In addition, a pair of flaps are illustrated, with at least one flap providing for closure of the pocket.

An expandable envelope construction is also known for shipping CDs wherein the front and back are each provided with score lines spaced inwardly of the edges in order to permit the envelope to expand upon the insertion of a CD holder while retaining a flat appearance. The envelope is made from a blank having a rectangular panel to form the face of the envelope and from which trapezoidal shaped flaps extend from two sides, a second panel extends from the bottom to eventually form part of the back of the envelope and a closure flap extends from the top. The back panel folds over the face panel as well as over the side flaps to form a pocket. In addition, the back panel has a trapezoidal shaped section with edges which face the edges of the side flaps when the envelope is empty and flat. The closure flap has similar edges to face the side flaps at the top comers. However, when the envelope is stuffed, the comers of the envelope tend to open. As a result not only are the contents not completely sealed from the outside environment but also the appearance of the back of the envelope is less than desirable.

Accordingly, it is an object of this invention to provide an aesthetically pleasing envelope construction which is of an expandable nature.

It is another object of the invention to provide an expandable envelope construction which can be readily fabricated on automated equipment.

It is another object of the invention to provide a flat expandable envelope construction which can be filled to capacity while retaining the contents in a fully sealed condition while retaining a flat appearance.

Briefly, the invention is directed to an expandable envelope construction comprising a rectangular front panel, a pair of side flaps at opposite sides of the front panel for folding over the front panel along a vertical fold line, a back panel disposed over the front panel to form a pocket and a closure flap for folding over the back panel to close the pocket. In addition, each of the front and back panels and the side flaps is provided with score lines along each edge to allow for expansion of the pocket while maintaining the flat appearance of the envelope.

In accordance with the invention, each flap includes a first section which extends from a respective vertical fold line and a reduced second section which extends from the first section. In addition, the back panel is secured to the second section of each of the flaps by means of an adhesive on the flaps and has a trapezoidal section extending from the horizontal fold line in overlying unsecured relation to the first section of each the side flap. Likewise, the closure flap extends over the first section of each flap in an unsecured manner. Thus, upon insertion of materials into the pocket, the panels are expandable from each other to enlarge the thickness of the pocket while the comers of the pocket also expand while being maintained in a sealed condition.

The envelope construction is such that, upon insertion of materials into the pocket, the front and back faces expand from each other while the two sides and the bottom of the envelope construction collapse inwardly about the respective pairs of score lines adjacent the fold lines on each edge of the envelope construction. For example, for an envelope construction intended to have a thickness capacity of one-half inch, the score lines are spaced one-half inch from the adjacent fold line. The envelope may then be expanded from an empty flat condition to one in which the pocket is one-half inch thick while retaining a flat appearance.

After materials have been introduced into the pocket of the envelope construction, the closure flap is folded over the back face to close the pocket. To this end, the means for closing the pocket may include an adhesive strip along an inside edge of the closure flap and a removable barrier strip over the adhesive strip. Upon removal of the barrier strip, the adhesive strip is exposed for sealing purposes.

The closure flap may also include a horizontally disposed tear strip which, upon removal, unseals the remainder of the closure flap from the back face of the envelope construction so that the contents of the pocket may be removed. In order to facilitate removal of the tear strip, a stub is provided at one end of the tear strip to extend beyond the closure flap for manual gripping.

In another embodiment, the envelope construction may have means on the closure flap between the tear strip and the front panel for reclosing the closure flap over the back panel. Such a reclosing means may be in the form of a ribbon for wrapping about the panels or may be in the form of an adhesive strip which is covered over by a releasable barrier strip or in the form of Velcro strips or elements.

The envelope construction may be made in various sizes in order to accommodate various materials to be retained in the pocket. For example, the envelope construction may be sized to receive letter size sheets of paper, magazines, catalogs and the like. The envelope construction may also be made of smaller sizes, for example, to receive and ship CD carriers.

In another embodiment, the expandable envelope construction may be made with a rectangular front panel having horizontal and vertical score lines as above with angularly disposed score lines extending to a respective comer of the panel. In addition, a pair of flaps are disposed at opposite sides of the front panel with each flap being folded over along a vertical fold line. In this embodiment, a back panel extends from and is folded over the front panel along a horizontal fold line and is secured to the flaps to define a pocket. The back panel is also provided with horizontal and vertical score lines as well as angularly disposed score lines extending from the intersection of a horizontal and vertical score line to a comer of the back panel.

In this embodiment, the side flaps need extend only a short distance inwardly of the front panel thereby terminating short of an adjacent vertical score line on the back panel as the front and back panels secured at the comers without any gaps therebetween.

The envelope construction may be readily made from a single blank which can be pre-scored and provided with fold lines. In addition, the equipment for folding the blank may be of simple construction. For example, the equipment may be automated to have a folding station in which flaps on the sides of a panel of blank are folded over onto the panel, a gluing station in which adhesive is applied to the folded over flaps and a second folding station in which another panel of the blank is folded over and secured to onto the side flaps to form a pocket. A further station may be used to apply adhesive or another type of securing means to the closure flap.

These and other objects and advantages of the invention will become more apparent from the following detailed description taken in conjunction with the accompanying drawings wherein.

Figure 9:
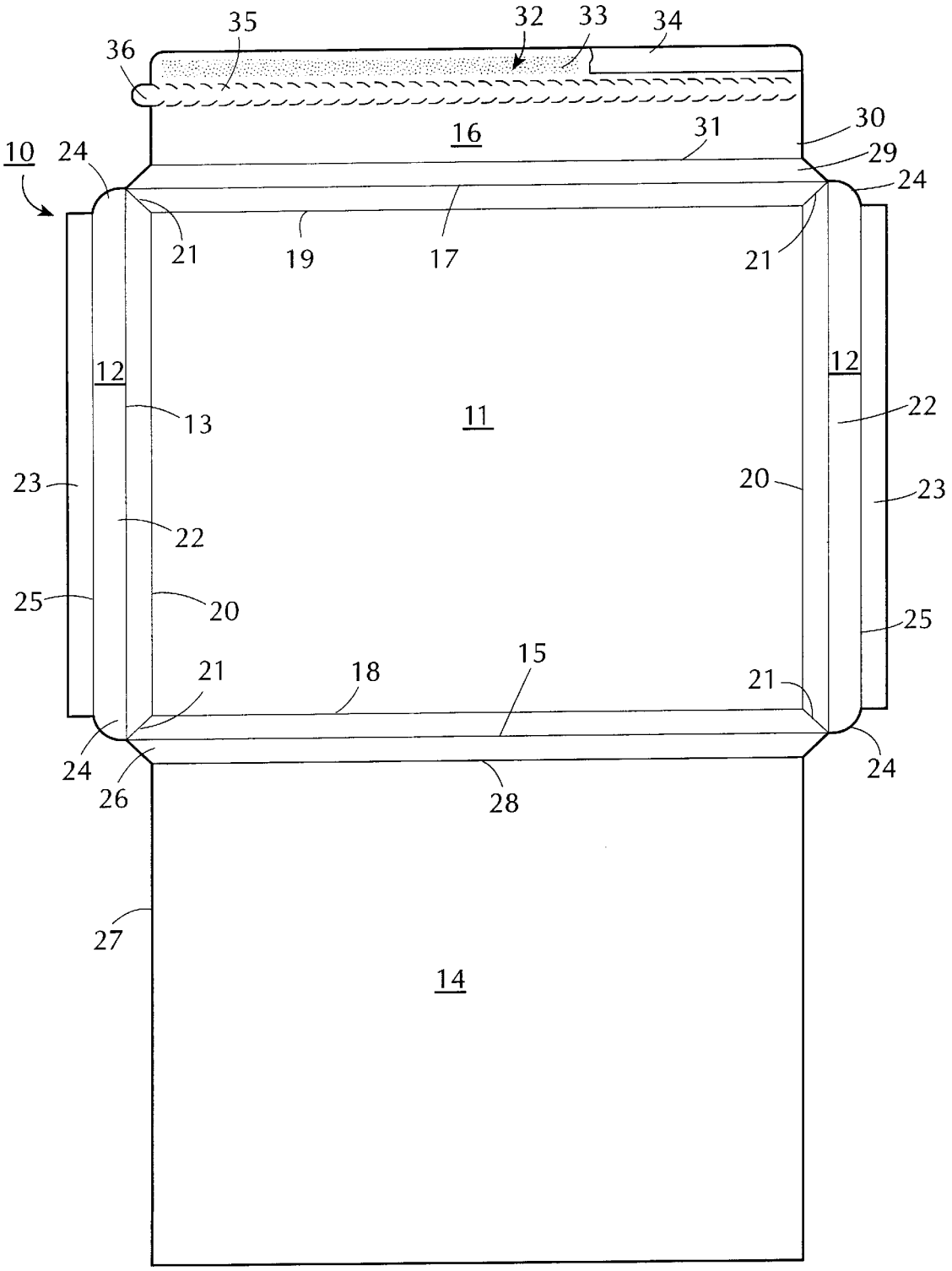
FIG. 9 illustrates a view of a blank for making the envelope construction of FIG. 10.

Referring to FIG. 9, the expandable envelope construction is made from a single blank 10 of paper or cardboard. As shown, the blank 10 has a rectangular panel 11 which is to define the front face of the envelope construction, a pair of flaps 12 at the opposite sides of the panel 11 for folding over along a vertical fold line 13 therebetween, a back panel 14 which extends from and which is to be folded over the front panel 11 along a horizontal fold line 15 therebetween to form a pocket and a closure panel 16 which is to define a closure flap and which extends from the front panel 11 along a horizontal fold line 17 therebetween for folding over the back panel 14 to close the pocket.

The front panel 11 has a horizontally disposed score line 18 spaced from a bottom edge, for example, the score line may be spaced one half inch from the bottom edge. The front panel 11 also has a horizontally disposed score line 19 spaced, for example, one half inch from the top edge, as well as a pair of vertically disposed score lines 20 each spaced, e.g. one half inch from the respective edge. In addition, a plurality of angularly disposed score lines 21 are also provided in the front panel 11 with each angularly disposed score line 21 extending from an intersection of a horizontal score line 18,19 with a vertically disposed score line 21 to a comer of the front panel.

Each side flap 12 includes a first section 22 which extends from a vertical fold line 13 and a reduced second section 23 which extends from the first section 22. As shown, the first section 22 is of the same height as the front panel 11 and has a rounded comer 24 at each end so as to taper inwardly toward the reduced section 23 for purposes as described below. The reduced section 23 is of a height which is sufficient to act as a glue strip to enable securement of the closure flap 14 in place to close the pocket of the envelope construction.

Each side flap 12 also has a vertically disposed score line 25 spaced from the fold line 13 and defining the boundary between the two sections 22,23 of the flap 12.

The back panel 14 has a trapezoidal section 26 which extends from the fold line 15 and a reduced rectangular section 27 which extends from the trapezoidal section 27. The back panel 14 also has a horizontally disposed score line 28 defining a boundary between the two sections 26,27 which is spaced from the fold line 15 between the front and back panels, for example at a spacing of one-half inch. The trapezoidal section 26 is of a width so that when folded over the side flaps 12, the triangular ends of the trapezoidal section 26 overlie the rounded comers 24 of the first sections of the side flaps 12. The rectangular section 27 is of a width to overlie the score lines 25 on the side flaps 12 as well as a small part of the first section 22 of each side flap 12 and is of a height to extend to the height of the first section 22 of each side flap 12, that is to the juncture between the two sections 22,23 of the side flaps 12.

The closure flap 16 has a first trapezoidal section 29 extending from the front panel 11, a reduced rectangular section 30 extending from the trapezoidal section 29 and a horizontal score line 31 parallel to the fold line 17 and defining a boundary between the two sections 29,30. The trapezoidal section 29 is of a width so that when folded over the side flaps 12, the triangular ends of the trapezoidal section 29 overlie the rounded comers 24 of the first sections 22 of the side flaps 12. The rectangular section 30 has a width which is equal to the width of the rectangular section 27 of the closure flap 13 for closing the pocket of the envelope construction.

The closure flap 16 includes means 32 for securing the flap 16 to the back panel 14 in order to close the pocket. The securing means 32 may be in the form of an adhesive strip 33 which is covered over by a releasable barrier strip 34 of known construction. In this respect, once the barrier strip 34 is removed, the adhesive strip 33 is exposed and can be used to seal the envelope construction in a closed condition.

The closure flap 16 also includes a horizontally disposed tear strip 35 between the securing means 32 and the score line 31. As shown, the tear strip 35 is provided with a tab 36 at one end which extends beyond the flap 16 for manual gripping thereof.

A suitable adhesive (not shown) is applied to the underside of the first sections 22 of the side flaps 12 so that when the side flaps 12 are folded over the front panel 11, the back panel 14 can be secured thereto.

The blank 10 is suitably prescored with the score lines and fold lines and provided with the securing means 32 so that a stack of blanks may be supplied to automated equipment for processing into envelope constructions. For example, the equipment used to fabricate the envelope need only employ a side edge folding station for folding the side flaps 12 over, an adhesive applying station to apply adhesive to the folded over flaps 12 (and/or to the back panel 14) and a folding station for folding the back panel 14 onto the side flaps 12 for adhesion and securement thereto to form the finished envelope construction.

When fabricated the envelope construction is empty and flat.

Figure 1:
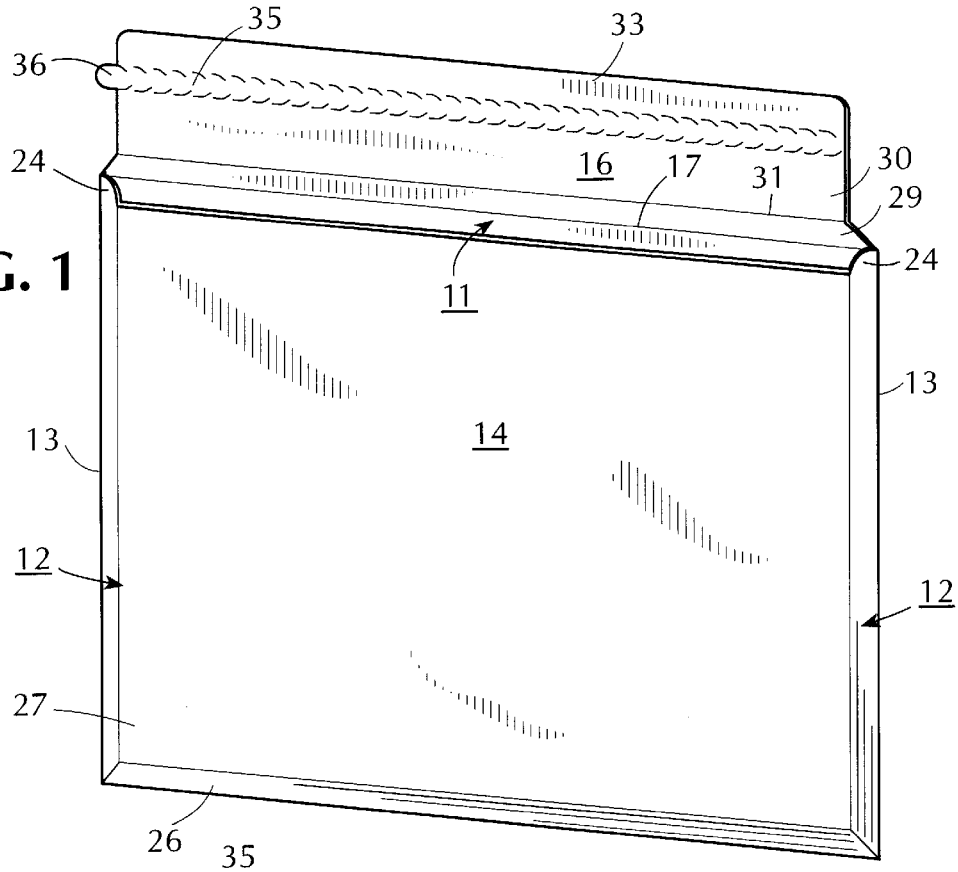
FIG. 1 illustrates a back perspective view of an envelope construction in accordance with the invention in an opened state.
Figure 2:
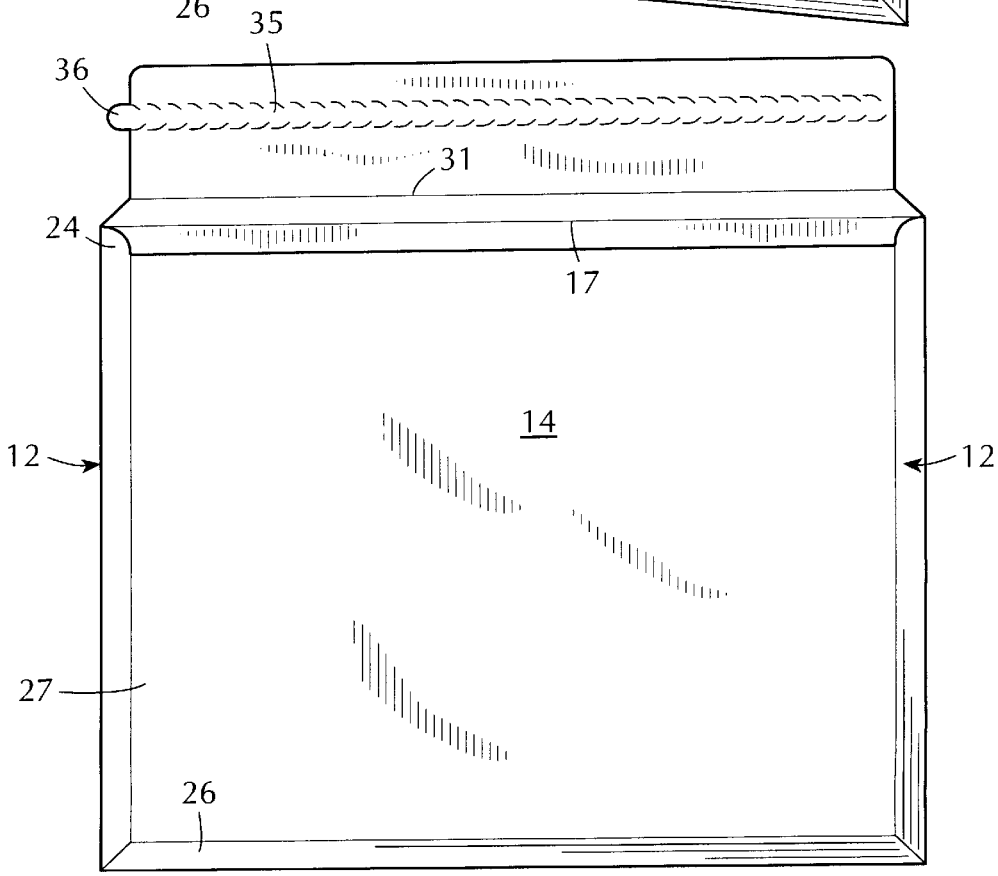
FIG. 2 illustrates a back view of the envelope of FIG. 1 in a flat and empty state.
Figure 3:
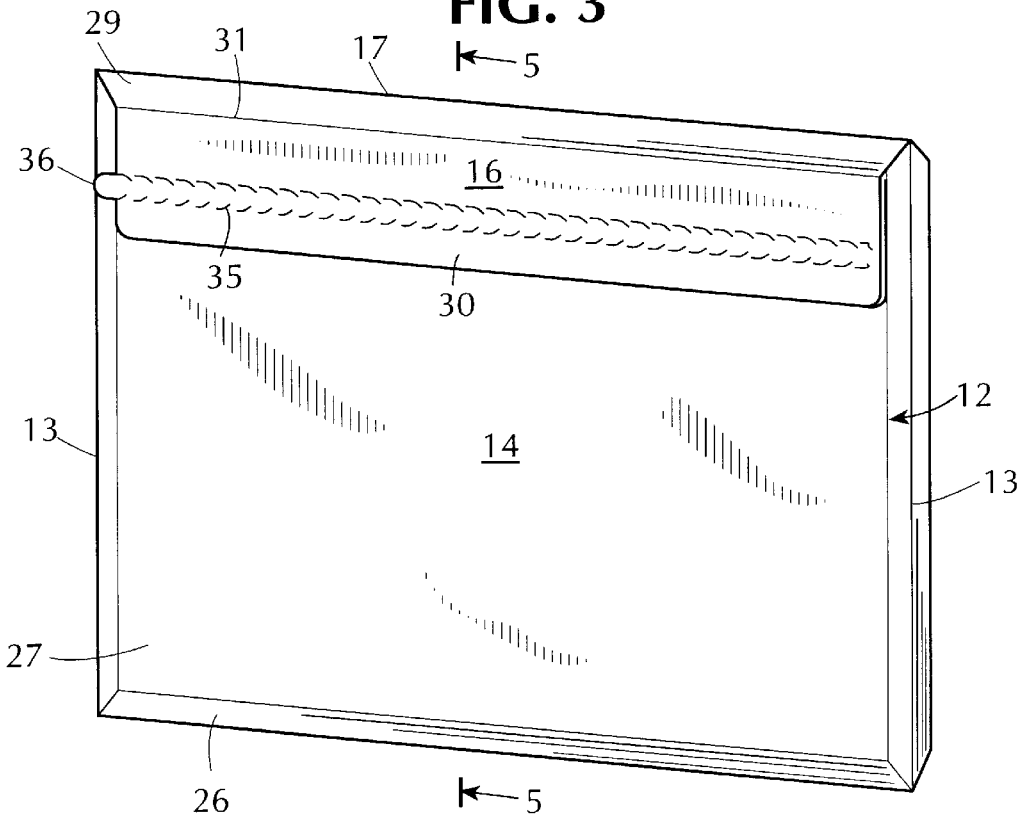
FIG. 3 illustrates a back view of the envelope of FIG. 1 in a closed and filled-to-capacity condition.
Figure 6:
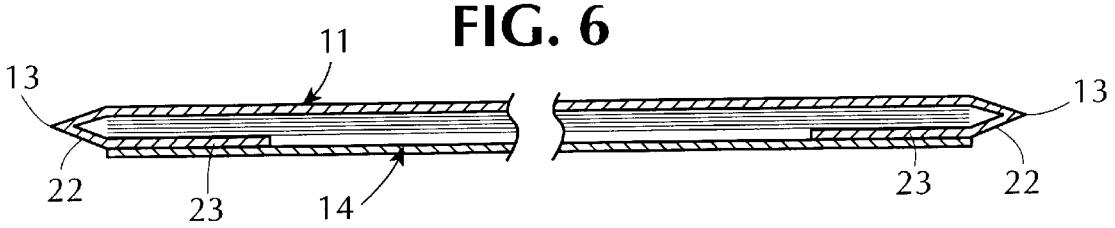
FIG. 6 illustrates a view taken on line 6—6 of FIG. 4.
Figure 4:
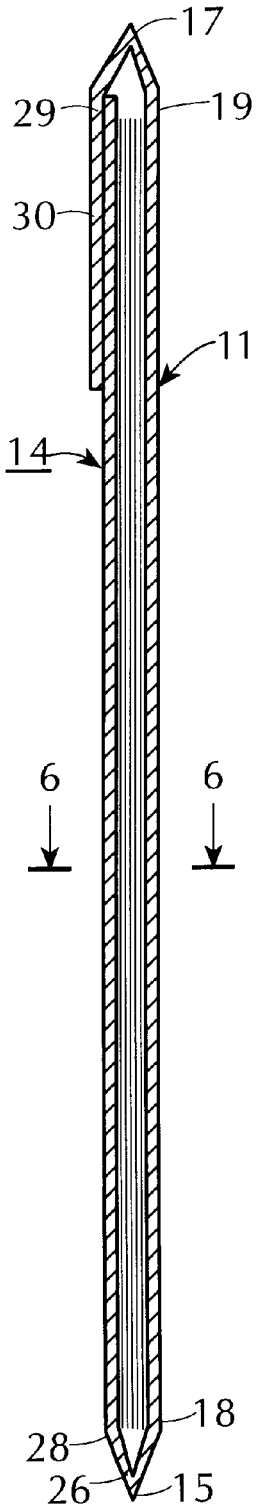
FIG. 4 illustrates a cross-sectional view of the envelope in a partially filled condition.
Figure 8:
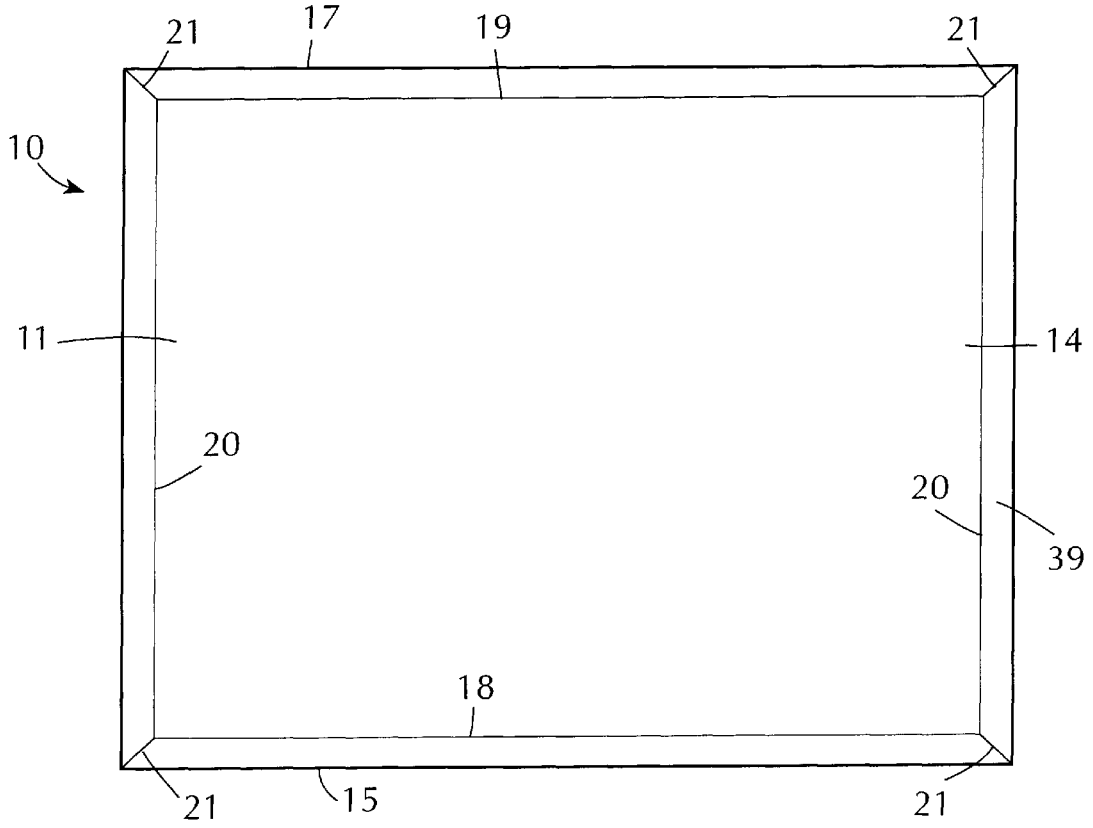
FIG. 8 illustrates a front view of the envelope construction of FIG. 3.

Referring to FIGS. 1 and 2, wherein like references indicate like parts as above, when the envelope construction is placed in use, the closure flap 13 is lifted as indicated in FIG. 1 and the pocket between the front panel 11 and the back panel 14 is opened to permit materials to be deposited into the pocket in a conventional manner. If, for example, a few sheets of paper 37 are inserted into the envelope, as indicated in FIGS. 4 and 6, the closure flap 16 is simply laid back over the back panel 14 and sealed thereto as indicated in FIG. 3. The overall appearance of the closed and partially filled envelope is that of a smooth flat envelope as shown if FIG. 8.

Figure 7:
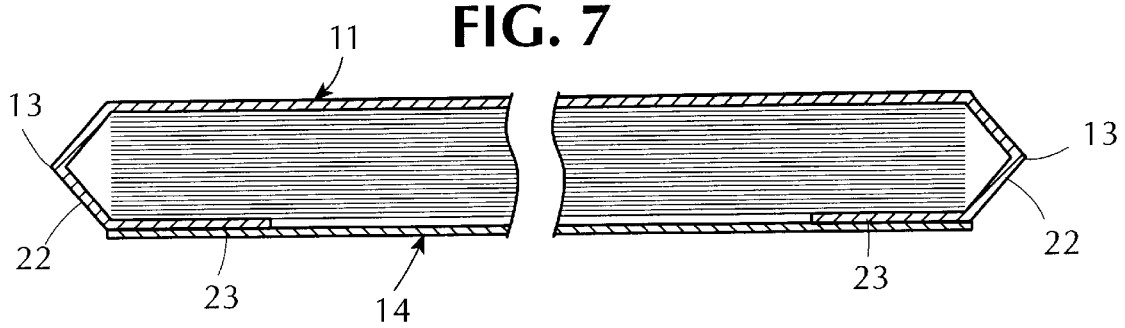
FIG. 7 illustrates a view taken on line 7—7 of FIG. 5.
Figure 5:
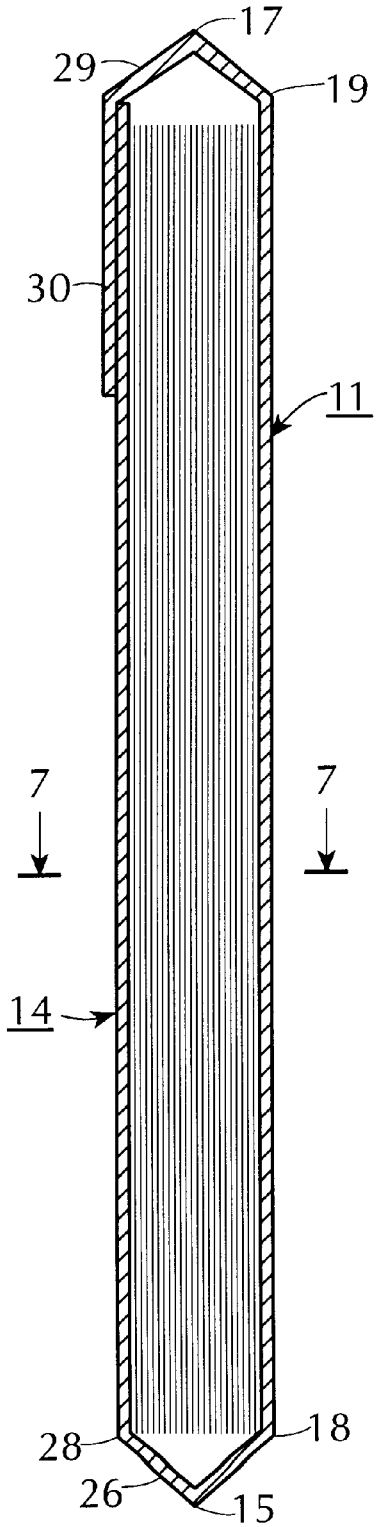
FIG. 5 illustrates a view taken on line 5—5 of FIG. 3.

In the event that the design capacity of the envelope is to be fully utilized, a stack of paper sheets, a magazine, a catalog or the like 38 of a thickness of one-half inch is stuffed into the pocket, as shown in FIGS. 5 and 7. At this time, the front and back panels 11,14 are expanded from each other so that the thickness of the pocket is enlarged as shown in FIG. 5 while at the same time, the width of the pocket is decreased. In this respect, as the front and back panels 11, 14 expand from each other, the two sides and bottom of the envelope construction collapse inwardly. Specifically, as the envelope expands in thickness e.g. from the partially filled condition of FIG. 4, to the full capacity condition of FIG. 5, the edge portions between a vertical score line 20,25 and a fold line 13 pivots inwardly about the score lines 20,25 thereby allowing the pocket to increase in thickness while also decreasing in width. During the expansion of the pocket, the ends of the trapezoidal section 26 of the back panel 14 which overlie the rounded comers 24 of the side flaps 12 and which are not secured thereto slide relative to the rounded comers while maintaining contact so as to maintain the pocket and the contents 37,38 in a sealed condition. At the same time, the ends of the trapezoidal section 29 of the closure flap 16 move relative to the rounded comers 24 at the tops of the side flaps 12 as these ends are likewise not secured to the rounded comers 24 so that a sealed condition is maintained at the top of the envelope construction. Instead of using rounded comers 24, any other type of an enlarged ear may be used.

After the envelope pocket has been filled, the barrier strip 34 on the closure flap 16 is removed to expose the adhesive strip 33 and the closure flap 13 brought down over the back panel 14 and sealed via the adhesive strip 33 to the back panel (FIG. 3).

The envelope construction may be made of various sizes to accommodate magazines, manuscripts, stacks of letter size papers, CD carriers and the like.

In order to open the envelope, the tear-strip 35 is simply manually removed from the closure flap 16 leaving the remainder of the flap 16 free to be folded back so that the contents in the pocket may be removed.

For purposes of enhancing the appearance of the construction, the edge margins of the envelope construction on each side may be provided with shading 39 (see FIGS. 1 and 8) from each edge of the envelope construction to the adjacent score line.

Referring to FIG. 3, where the back panel 14 is secured to and over the side flaps 12, the back panel 14 and the folded over side flaps 12 constitute a back face of the envelope construction. Alternatively, the back panel 14 may constitute the front face of an envelope construction, for example where address and mailing information is provided on the back panel 14. Hence, the term "face" is used simply as a matter of reference to the embodiment illustrated in the drawings.

Figure 10:
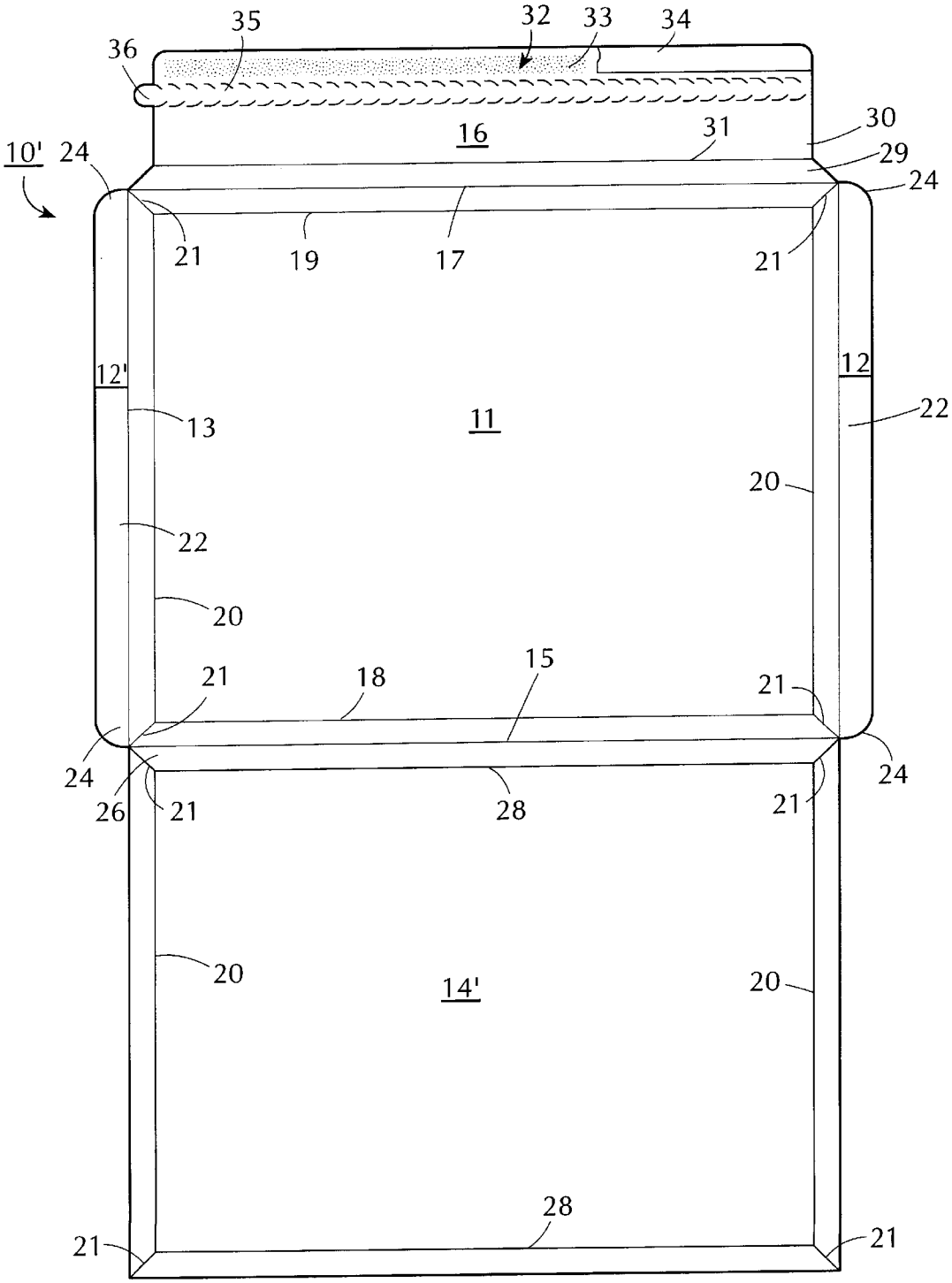
FIG. 10 illustrates a view similar to FIG. 9 of a blank for making a modified envelope construction in accordance with the invention.

In another embodiment, as shown in FIG. 10, wherein like reference characters indicate like parts as above, a blank 10' for forming the envelope construction may employ side flaps 12' of limited width. In this case, the envelope construction may have a front panel 11 constructed, as above, and a back panel 14' of the same width and approximately the same height. In addition, the back panel 14' is provided with a rectangular frame of score lines, i.e. a pair of parallel vertical score lines 20 and a pair of parallel horizontal score lines 28 as well as angularly disposed score lines 21 which extend from the intersections of the horizontal and vertical score lines to a comer of the back panel. In this construction, the side flaps 12' extend to a point which terminates short of the vertical score lines 20 of the back panel 14'.

The closure flap for this embodiment may have the same construction as the closure flap as in the illustrated embodiment.

It is to be noted that the closure flap may have any suitable configuration. For example, instead of having a rectangular configuration as illustrated in FIG. 3, the flap may have a trapezoidal shaped end section, a rounded terminal end section (as shown in FIG. 10) or any other conventional shape.

In order to reuse the envelope, the closure flap may be provided with a means (not shown) for reclosing the flap over the back panel. Such a means may include a ribbon, such as used on a conventional red rope folder. Alternatively, the means for reclosing the envelope construction may be in the form of an adhesive strip which is covered over by a releasable barrier strip. Thus, upon removal of the barrier strip the exposed adhesive may be used to reseal the envelope.

In other embodiments the means for securing the closure flap may be of reusable nature, for example, Velcro type elements or strips may be used.

The invention thus provides an expandable envelope construction which is able to expand while still appearing flat. That is to say, the envelope construction looks just as good with one sheet of paper or when filled to capacity as opposed to other expandable envelopes which look good only when filled to capacity. Further, the envelope construction utilizes less space than a gusseted expandable envelope of conventional construction. Further, the expense of the envelope construction is less than that of a gusseted envelope.

The invention further provides an envelope construction which can be easily made by using of a single blank on automated equipment.

The invention also allows papers and the like inserts to be stuffed into the expandable envelope without interference from internally disposed gussets.

What is claimed is:

1. An expandable envelope construction comprising a rectangular front panel having a horizontally disposed score line spaced from a bottom edge thereof, a horizontally disposed score line spaced from the top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective comer of said panel;

a pair of side flaps at opposite sides of said front panel, each said flap being folded over said front panel along a vertical fold line therebetween and including a vertically disposed score line spaced from said fold line, each said flap including a first section extending from a respective vertical fold line and a reduced second section extending from said first section;

a back panel extending from and folded over said front panel along a horizontal fold line therebetween, said back panel being secured to said second section of each of said flaps to define a pocket and having a horizontally disposed score line spaced from said fold line between said front and back panels, said back panel having a trapezoidal section extending from said horizontal fold line and disposed in overlying relation to said first section of each said side flap; and a closure flap extending from said front panel along a horizontal fold line therebetween for folding over said back panel and said first section of each said flap to close said pocket, said closure flap having a horizontally disposed score line spaced from said fold line between said closure flap and said front panel whereby upon insertion of materials into said pocket, said panels are expandable from each other to enlarge the thickness of said pocket while said pocket is maintained in a sealed condition.

2. An expandable envelope construction as set forth in claim 1 wherein said closure flap has a first trapezoidal section extending from said front panel and disposed in overlying relation to said first section of each said first flap.

3. An envelope construction as set forth in claim 2 wherein said closure flap has a rectangular section extending from said trapezoidal section of a width equal to the distance between said vertically disposed score lines of said back face.

4. An envelope construction as set forth in claim 1 wherein said closure flap includes means for securing said closure flap to said back panel to close said pocket and includes a horizontally disposed tear strip between said means and said score line thereof.

5. An envelope construction as set forth in claim 4 wherein said tear strip has a tab at one end extending beyond said flap for manual gripping thereof.

6. An envelope construction as set forth in claim 4 which further comprises means on said closure flap between said tear strip and said front panel for reclosing of said closure flap over said back panel.

7. An envelope construction as set forth in claim 6 wherein said means for reclosing includes an adhesive strip on said closure flap and a releasable barrier strip disposed over said adhesive strip.

8. An envelope construction as set forth in claim 1 characterized in being sized to receive a CD disc carrier therein.

9. An envelope construction as set forth in claim 1 wherein at least one of said panels is characterized in having shading between a score line and an adjacent fold line to impart an aesthetic appearance thereto.

10. An envelope construction as set forth in claim 1 which further comprises an adhesive on said first section of each said side flap securing said first section to said back panel.

11. A blank for an expandable envelope construction comprising a rectangular front panel having a horizontally disposed score line spaced from a bottom edge thereof, a horizontally disposed score line spaced from the top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective comer of said panel;

a pair of side flaps at opposite sides of said front panel, each said flap being foldable over said front panel along a vertical fold line therebetween and including a vertically disposed score line spaced from said fold line, each said flap including a first section extending from a respective vertical fold line and a reduced second section extending from said first section;

a back panel extending from and foldable over said front panel along a horizontal fold line therebetween, said back panel being securable to said second section of each of said flaps to define a pocket and having a horizontally disposed score line spaced from said fold line between said front and back panels, said back panel having a trapezoidal section extending from said horizontal fold line and disposed in overlying relation to said first section of each said side flap; and a closure flap extending from said front panel along a horizontal fold line therebetween for folding over said back panel and said first section of each said flap to close the pocket, said closure flap having a horizontally disposed score line spaced from said fold line between said closure flap and said front panel whereby upon insertion of materials into said pocket, said panels are expandable from each other to enlarge the thickness of said pocket while the pocket is maintained in a sealed condition.

12. A blank as set forth in claim 11 wherein said closure flap has a first trapezoidal section extending from said front panel and disposed in overlying relation to said first section of each of said side flaps.

13. A blank as set forth in claim 11 wherein said closure flap has a rectangular section extending from said trapezoidal section of a width equal to the distance between said vertically disposed score lines of said back face.

14. A blank as set forth in claim 11 which further comprises an adhesive on said first section of each said side flap securing said section to said back panel.

* * * * *

UNITED STATES PATENT AND TRADEMARK OFFICE

CERTIFICATE OF CORRECTION

PATENT NO. : 6,227,444 B1
DATED : May 8, 2001
INVENTOR(S) : Marvin Makofsky and Jerome B. Schwartz It is certified that error appears in the above-identified patent and that said Letters Patent is hereby corrected as shown below:

Title page,
Item [12], "MAKOESKY" should be -- MAKOFSKY --.
Item [75], Inventors, "Makoesky" should be -- Makofsky --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,227,444 B1
DATED : May 8, 2001
INVENTOR(S) : Marvin A. Makoesky et al.

It is certified that error appears in the above-identified patent and that said Letters Patent is hereby corrected as shown below:

Column 2,
Lines 53 and 62, change “comer” to -- corner --.

Column 3,
Lines 57 and 62, change “comer” to -- corner --.

Column 4,
Lines 13 and 27, change “comers” to -- corners --.

Column 5,
Lines 23, 25, 29, 30 and 32, change “comers” to -- corners --.

Column 6,
Lines 4 and 55, change “comer” to -- corner --.

Column 8,
Line 10, change “comer” to -- corner --.

Signed and Sealed this

Ninth Day of May, 2006

JON W. DUDAS
*Director of the United States Patent and Trademark Office*